US008387592B2

(12) United States Patent
Rodatz et al.

(10) Patent No.: US 8,387,592 B2
(45) Date of Patent: Mar. 5, 2013

(54) METHOD AND APPARATUS FOR OPERATING AN INTERNAL COMBUSTION ENGINE

(75) Inventors: Paul Rodatz, Landshut (DE); Gerd Rösel, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 146 days.

(21) Appl. No.: 12/936,728

(22) PCT Filed: Mar. 2, 2009

(86) PCT No.: PCT/EP2009/052436

§ 371 (c)(1),
(2), (4) Date: Nov. 3, 2010

(87) PCT Pub. No.: WO2009/124808

PCT Pub. Date: Oct. 15, 2009

(65) Prior Publication Data

US 2011/0041819 A1 Feb. 24, 2011

(30) Foreign Application Priority Data

Apr. 9, 2008 (DE) ..... 10 2008 018 013

(51) Int. Cl.
*F02D 41/00* (2006.01)

(52) U.S. Cl. ..... 123/436; 123/672; 123/679

(58) Field of Classification Search ..... 123/672, 123/436, 679, 687; 60/285; 701/103–105, 701/109–110

See application file for complete search history.

(56) References Cited

U.S. PATENT DOCUMENTS

| | | | | |
|---|---|---|---|---|
| 5,115,639 | A | 5/1992 | Gopp | 60/274 |
| 5,337,557 | A | 8/1994 | Toyoda | 60/276 |
| 5,497,618 | A | 3/1996 | Brailsford et al. | 60/274 |
| 5,637,276 | A | 6/1997 | Carnevale et al. | 422/94 |
| 6,550,307 | B1 | 4/2003 | Zhang et al. | 73/23.32 |

(Continued)

FOREIGN PATENT DOCUMENTS

| | | |
|---|---|---|
| DE | 4219899 | 1/1993 |
| DE | 4306055 | 9/1993 |

(Continued)

OTHER PUBLICATIONS

International Search Report and Written Opinion for Application No. PCT/EP2009/052436 (13 pages), Jul. 17, 2009.

*Primary Examiner* — Hai Huynh
(74) *Attorney, Agent, or Firm* — King & Spalding L.L.P.

(57) ABSTRACT

An internal combustion engine has at least one cylinder, with which an injection valve for metering fuel is associated and an exhaust system with an exhaust gas catalytic converter. A first exhaust gas probe is disposed upstream of or in the exhaust gas catalytic converter, and a second exhaust gas probe is downstream. A lambda controller determines a regulating variable as a function of the first probe and a control variable acting on a fuel mass to be metered using the injection valve. A trim regulator determines a regulating variable thereof as a function of the second probe and the first trim control variable thereof as a function of a P regulator component and the second trim control variable thereof as a function of an I regulator component. A function of a predetermined evaluation of the first trim control variable decides whether the second trim control variable is adapted.

20 Claims, 4 Drawing Sheets

U.S. PATENT DOCUMENTS

| | | | | |
|---|---|---|---|---|
| 6,575,152 | B2 | 6/2003 | Poggio et al. | 123/681 |
| 7,028,464 | B2 * | 4/2006 | Rosel et al. | 60/285 |
| 7,389,683 | B2 * | 6/2008 | Beer et al. | 73/114.04 |
| 7,431,025 | B2 | 10/2008 | Cianciara et al. | 123/696 |
| 2005/0072139 | A1 | 4/2005 | Kato | 60/285 |
| 2008/0009997 | A1 * | 1/2008 | Ketterer et al. | 701/101 |
| 2011/0146238 | A1 * | 6/2011 | Rodatz et al. | 60/274 |

FOREIGN PATENT DOCUMENTS

| | | |
|---|---|---|
| DE | 19856367 | 6/2000 |
| DE | 60108810 | 1/2006 |
| DE | 102005045888 | 9/2006 |
| EP | 0694684 | 1/1996 |

* cited by examiner

METHOD AND APPARATUS FOR OPERATING AN INTERNAL COMBUSTION ENGINE

CROSS-REFERENCE TO RELATED APPLICATIONS

This application is a U.S. National Stage Application of International Application No. PCT/EP2009/052436 filed Mar. 2, 2009, which designates the United States of America, and claims priority to German Application No. 10 2008 018 013.0 filed Apr. 9, 2008, the contents of which are hereby incorporated by reference in their entirety.

TECHNICAL FIELD

The invention relates to a method and an apparatus for operating an internal combustion engine.

BACKGROUND

Ever stricter legal specifications in respect of permissible pollutant emissions of motor vehicles, in which internal combustion engines are arranged, render it necessary to keep the pollutant emissions as low as possible during operation of the internal combustion engine. This can take place on the one hand by the pollutant emissions, which are produced during the combustion of the air/fuel mixture in the respective cylinder of the internal combustion engine, being reduced.

On the other hand, exhaust gas after-treatment systems are used in internal combustion engines, which convert the pollutant emissions produced during the combustion process of the air/fuel mixture in the respective cylinders, into harmless substances.

To this end, exhaust gas catalytic converters are used, which convert carbon monoxide, hydrocarbons and nitrogen oxides into harmless substances.

Both the targeted influence of the generation of the pollutant emissions during the combustion and also the conversion of the pollutant components with a high degree of efficiency by means of the exhaust gas catalytic converter require a very precisely adjusted air/fuel ratio in the respective cylinder. The technical book "Handbuch Verbrennungsmotoren" [Combustion engine manual], publisher Richard van Basshuysen, Fred Schäfer, $2^{nd}$ edition, Vieweg and Sohn Verlagsgesellschaft mbH, June 2002, pages 559 to 561, discloses a linear lambda controller with a lambda probe, which is arranged upstream of an exhaust gas catalytic converter, and a binary lambda probe, which is arranged downstream of the exhaust gas catalytic converter. A lambda set value is filtered by means of a filter, which takes the gas travel times and the sensor behavior into account. The thus filtered lambda set value is the regulating variable of a $PII^2D$-lambda regulator, the control variable of which is an injection quantity correction. The signal of the linear lambda probe is converted into a detected lambda value by way of a stored characteristic curve. This characteristic curve is subjected to a correction by means of a trim regulator. The trim controller assigned to the trim regulator is embodied as a PI controller, which uses the after-cat probe exposed to less cross sensitivities, which is preferably assigned by a binary bistable sensor arranged downstream of the exhaust gas catalytic converter.

The trim regulator is used to monitor the catalytic conversion and fine tuning of the mixture.

SUMMARY

According to various embodiments, a method and an apparatus for operating an internal combustion engine can be created, which contributes to a low emission operation of the internal combustion engine.

According to an embodiment, in a method for operating an internal combustion engine having at least one cylinder, to which an injection valve is assigned for metering the fuel, having an exhaust gas tract, in which an exhaust gas catalytic converter is arranged, a first exhaust gas probe upstream of or in the exhaust gas catalytic converter and a second exhaust gas probe downstream of the exhaust gas catalytic converter, with a lambda controller being provided, the regulating variable of which is determined as a function of a measuring signal of the first exhaust gas probe and the control variable of which acts on a fuel mass to be metered by means of the injection valve, with a trim regulator also being provided, the regulating variable of which is determined as a function of a measuring signal of the second exhaust gas probe and the first control variable of which is determined as a function of a P regulator component of the trim regulator and the second trim control variable of which is determined as a function of an I regulator component of the trim regulator,

- as a function of a predetermined evaluation of the first trim control variable, a decision being made to determine whether an adjustment of the second trim control variable is to take place,
- an adjustment of the second trim control variable being implemented if it was decided that an adjustment of the second trim control variable is to take place.

According to a further embodiment, a comparison of the first trim control variable or a trim characteristic value determined as a function thereof, can be carried out within the scope of the evaluation with at least one predetermined trim threshold value, and a decision is made as a function of the comparison to determine whether an adjustment of the second trim control variable is to be carried out. According to a further embodiment, a check can be carried out within the scope of the evaluation to determine whether the first trim control variable or the trim characteristic value determined as a function thereof exceeds the respective predetermined threshold value for a predetermined duration or a predetermined air mass flow integral according to amount. According to a further embodiment, the predetermined evaluation can be implemented as a function of a filtered first trim variable. According to a further embodiment, a check can be carried out within the scope of the evaluation to determine whether a gradient of the second trim control variable exceeds a predetermined gradient threshold value according to amount. According to a further embodiment, a check can be carried out within the scope of the evaluation to determine whether the gradient of the trim control variable has the same sign as the first trim control variable. According to a further embodiment, an adjustment value can be predetermined, by means of which the adjustment of the second trim control variable is implemented. According to a further embodiment, the adjustment value can be determined as a function of a speed which represents the load variable on the internal combustion engine. According to a further embodiment, the adjustment value can be determined as a function of the first trim control variable. According to a further embodiment, a complementarily acting adjustment of the first trim control variable can be implemented if an adjustment of the second trim control variable is implemented by means of the adjustment value.

According to another embodiment, an apparatus for operating an internal combustion engine having at least one cylinder, to which an injection valve for metering fuel is assigned, has an exhaust gas tract, in which an exhaust gas catalytic converter is arranged, a first exhaust gas probe arranged upstream of or in the exhaust gas catalytic converter and a second exhaust gas probe downstream of the exhaust gas catalytic converter, with a lambda regulator being provided, the control variable of which is determined as a function of a measuring signal of the first exhaust gas probe, and the control variable of which acts on a fuel mass to be metered by means of the injection valve, with a trim regulator also being provided, the regulating variable of which is determined as a function of a measuring signal of the second exhaust gas probe and the first trim control variable of which is determined as a function of a P regulator component of the trim regulator and the second trim control variable of which is determined as a function of an I regulator component of the trim regulator, with the apparatus being embodied, —to decide as a function of a predetermined evaluation of the first trim control variable whether an adjustment of the second trim control variable is to take place and—to implement an adjustment of the second trim control variable if it was decided that an adjustment of the second trim control variable is to take place.

BRIEF DESCRIPTION OF THE DRAWINGS

Exemplary embodiments are described in more detail below with reference to the schematic drawings, in which.

Elements with the same structure or function are identified with the same reference characters throughout the figures.

DETAILED DESCRIPTION

Figure 1:
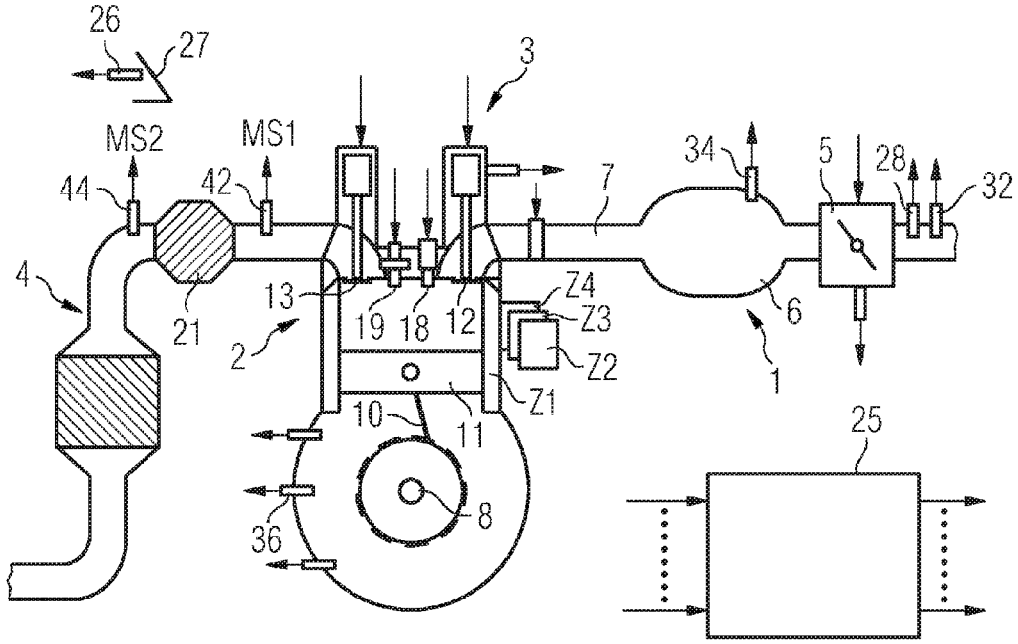
FIG. 1 shows an internal combustion engine having a control apparatus.

According to various embodiment, in a method and a corresponding apparatus for operating an internal combustion engine having at least one cylinder, to which a fuel injection valve for metering the fuel is assigned, the internal combustion engine also comprises an exhaust gas tract, in which an exhaust gas catalytic converter is arranged. A first exhaust gas probe is also arranged in the exhaust gas tract upstream of or in the exhaust gas catalytic converter and a second exhaust gas probe is arranged downstream of the exhaust gas catalytic converter. A lambda controller is provided, the regulating variable of which is determined as a function of a measuring signal of the first exhaust gas probe, and the control variable of which acts on a fuel mass to be metered by means of the fuel injection valve. A trim regulator is also provided, the regulating variable of which is determined as a function of a measuring signal of the second exhaust gas probe and the first trim control variable of which is determined as a function of a P regulator component of the trim regulator and the second trim control variable of which is determined as a function of an I regulator component of the trim regulator. As a function of a predetermined evaluation of the first trim control variable, a decision is made as to whether an adjustment of the second trim control variable is to take place. If it was decided that an adjustment of the second trim control variable is to take place, an adjustment of the second trim control variable is performed.

A significant reduction in increased pollutant emissions can be particularly effectively achieved in this way within a very short period of time, for instance in the case of contamination of an exhaust gas probe, after replacement of an exhaust gas probe or after deletion of the second trim control variable. The regular object assigned to the second trim control variable is to compensate for remaining control deviations, which are induced for instance by characteristic curve displacements of the first exhaust gas probe. Characteristic curve displacements of this type can arise for instance as a result of ageing and/or contamination.

In this context, it is particularly suitable to configure the I regulator component accordingly slowly, in order not to respond unnecessarily to very short-term interferences, which may occur for instance as a result of tank ventilation. In particular, with quick changes to the characteristic curve of the first exhaust gas probe, as occur in the case of contamination, after replacement of the probe or deletion of the second trim control variable for instance, the second trim control variable can only correct such control deviations slowly by means of the integration of the control deviations. In this time frame, it is then necessary for a correction to take place by means of the first trim control variable and thus to take place as a function of the P regulator component. In contrast to the second trim control variable, the first trim control variable is however generally only taken into account in selected operating states.

As a result, allowances are not made for the changed circumstances outside of these selected operating state and an increased emission of pollutants thus then takes place.

By providing the predetermined evaluation of the first trim control variable and on the basis of its decision as to whether an adjustment of the trim control variable is to take place and of the implementation of the adjustment of the trim control variable, it is then in contrast possible to very rapidly make a contribution to further reducing pollutant emissions of this type again.

According to an embodiment, a comparison of the first trim control variable or a trim characteristic value determined as a function thereof is carried out within the scope of the evaluation with at least one predetermined trim threshold value and a decision is made as a function of the comparison to determine whether an adjustment of the second trim control variable is to take place. The evaluation can be carried out particularly easily in this way.

It is advantageous in this context if, within the scope of the evaluation, a check is carried out to determine whether the first trim control variable or the trim characteristic value determined as a function thereof exceeds the respective predetermined threshold value for a predetermined period of time or a predetermined air mass flow integral according to amount. Particularly reliable operation of the internal combustion engine can be ensured in this way and an improper change in the second trim control variable is in particular avoided.

According to a further embodiment, the predetermined evaluation is implemented as a function of a filtered first trim variable. Outliers of the first trim control variable can be suitably filtered out in this way and an even more precise operation of the internal combustion engine can thus take place.

According to a further embodiment, a check is carried out within the scope of the evaluation to determine whether a gradient of the second trim control variable exceeds a predetermined gradient threshold value according to amount. It is then easily possible in this way to determine whether an adjustment requirement exists with the second trim control variable.

According to a further embodiment, a check is carried out within the scope of the evaluation to determine whether the gradient of the trim control variable has the same sign as the first trim control variable. The decision as to whether an adjustment of the second trim control variable is to take place can then also take place as a function of whether the gradient of the second trim control variable has the same sign as the second trim control variable.

According to a further embodiment, an adjustment value is predetermined, by means of which the adjustment of the trim control variable is implemented by means of the second trim control variable. A simple adjustment of the second trim control variable is possible in this way.

It is advantageous in this context if the adjustment value is determined as a function of a speed or a variable representing the load on the internal combustion engine. This may be conducive to a particularly quick and precise reduction in the pollutant emissions.

According to a further embodiment, the adjustment value is determined as a function of the first trim control variable. An effective contribution to a rapid reduction in pollutant emissions can thus be achieved.

According to a further embodiment, if an adjustment of the second trim control variable is implemented by means of the adjustment value, a complementary adjustment of the first trim control variable is implemented. A particularly quick suitable adjustment of the first trim control variable then takes place in this way, without the regulator input having to be observed for this purpose.

An internal combustion engine (FIG. 1) includes an intake tract 1, an engine block 2, a cylinder head 3 and an exhaust gas tract 4. The intake tract 1 preferably includes a throttle valve 5, also a manifold 6 and an intake pipe 7, which is guided to a cylinder Z1 by way of an inlet channel into the engine block 2. The engine block 2 also includes a crankshaft 8, which is coupled to the piston 11 of the cylinder Z1 by way of a connecting rod 10.

The cylinder head 3 includes a valve train having a gas inlet valve 12 and a gas outlet valve 13. The cylinder head also includes an injection valve 18 and an ignition plug 19. Alternatively, the injection valve 18 can also be arranged in the intake pipe 7.

An exhaust gas catalytic converter 21 is arranged in the exhaust gas tract 4, said exhaust gas catalytic converter 21 being embodied for instance as a three-way catalytic converter. A further exhaust gas catalytic converter is also arranged in the exhaust gas tract 4 for instance, said exhaust gas catalytic converter being embodied as a NOX catalytic converter.

A control apparatus 25 is provided, to which sensors are assigned, which detect different measured variables and each determine the value of the measured variable. In addition to the measured variables, operating variables also include variables derived herefrom. The control apparatus 25 is embodied to determine control variables as a function of at least one of the operating variables, said control variables then being converted into one or several control signals in order to control the control elements by means of corresponding control drives. The control apparatus can also be referred to as an apparatus for operating the internal combustion engine.

The sensors are a pedal position sensor 26, which detects an accelerator pedal position of an accelerator pedal 27, an air-flow sensor 28, which detects an air-flow current upstream of the throttle valve 5, a first temperature sensor 32, which detects an intake air temperature, an intake pipe pressure sensor 34, which detects an intake pipe pressure in the manifold 6, a crankshaft angle sensor 36, which detects a crankshaft angle, to which a speed N is then assigned.

A first exhaust gas probe 42 is also provided, which is arranged upstream of the exhaust gas catalytic converter 21 or in the exhaust gas catalytic converter 21, and which detects a residual oxygen content of the exhaust gas and the measuring signal MS1 of which is characteristic of the air/fuel ratio in the combustion chamber of the cylinder upstream of the first exhaust gas probe 42 prior to oxidation of the fuel, subsequently referred to as the air/fuel ratio in the cylinders Z1 to Z4. The first exhaust gas probe 42 can thus be arranged in the exhaust gas catalytic converter 21 such that part of the catalytic converter volume is disposed upstream of the first exhaust gas probe 42. The first exhaust gas probe 42 may be a linear lambda probe or for instance also a binary lambda probe.

A second exhaust gas probe 44 is also arranged downstream of the exhaust gas catalytic converter 21, which is used in particular within the scope of a trim regulator and which is preferably embodied as a simple binary lambda probe. The second exhaust gas probe can however basically also be embodied for instance as a linear lambda probe and the measuring signal of which is designated MS2.

Depending on the embodiment, any subset of the cited sensors may be present or additional sensors may also be present.

The control elements are for instance the throttle valve 5, the gas inlet and gas outlet valves 12, 13, the injection valve 18 or the ignition plug 19.

Aside from the cylinder Z1, other further cylinders Z2 to Z4 are preferably also still provided, to which corresponding control elements and if necessary sensors are then also assigned.

Figure 2:
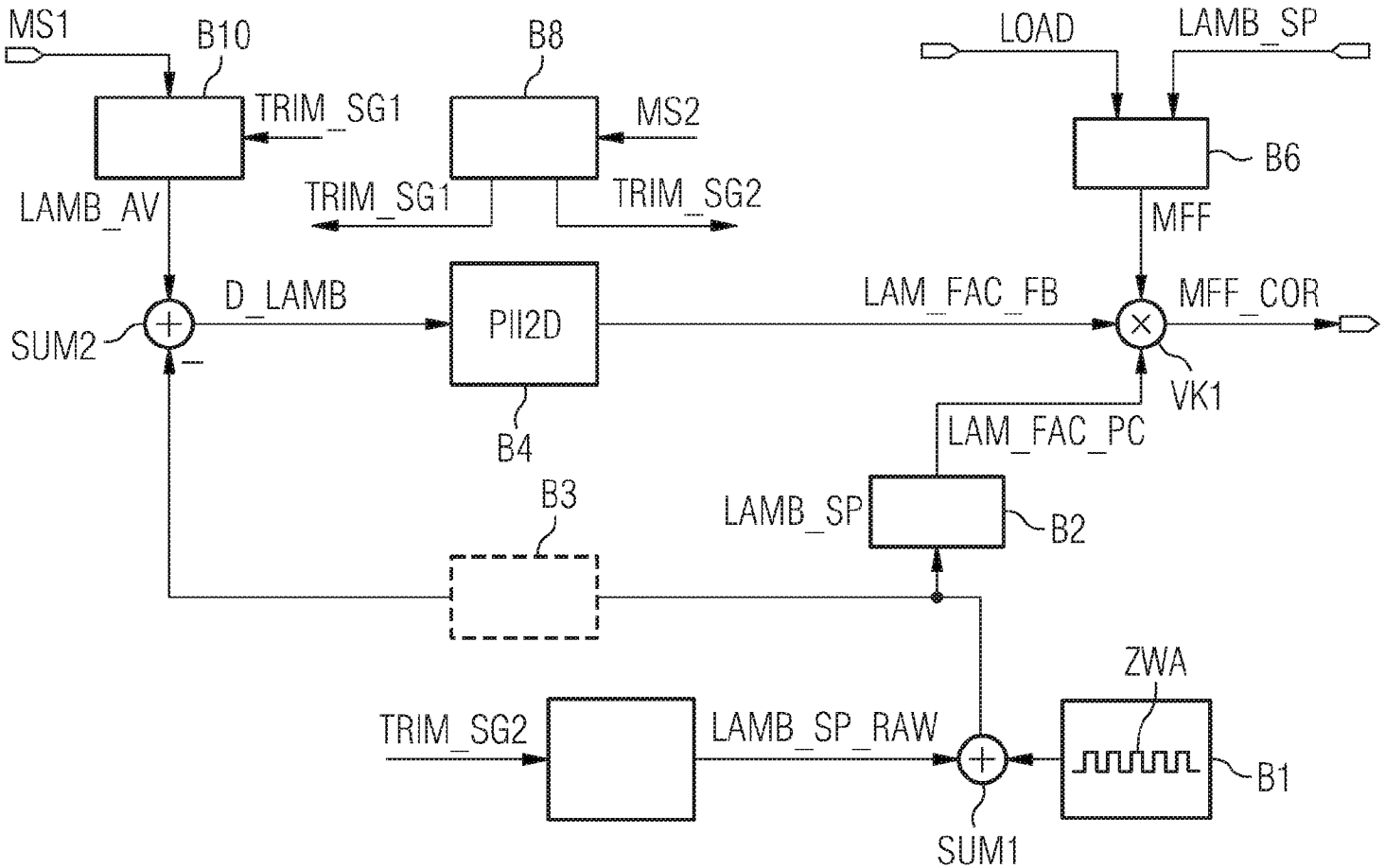
FIG. 2 shows a block diagram of part of the control apparatus of the internal combustion engine.

A block diagram of part of the control apparatus 25 is shown in FIG. 2. A predetermined set value LAMB_SP_RAW of the air/fuel ratio may essentially be fixedly predetermined in a particularly simple embodiment. It is however preferably determined for instance as a function of a current operating mode of the internal combustion engine, like a homogenous or layer operation, and/or as a function of operating variables of the internal combustion engine. In particular, the provided set value LAMB_SP_RAW of the air/fuel ratio in the combustion chambers of the cylinder can be predetermined as approximately the stoichiometric air/fuel ratio. The predetermined set value LAMB_SP_RAW of the air/fuel ratio can preferably also be influenced by a second trim control variable TRIM_SG2.

In a block B1, a forced activation signal ZWA is determined and in the first summing point SUM1, the predetermined set value LAMP_SP_RAW of the air/fuel ratio is modulated with the forced activation signal. The forced activation signal ZWA is a rectangular, trapezoidal or triangular signal for instance. The output variable of the first summing point SUM1 is then a predetermined air/fuel ratio in the combustion chambers of the cylinders Z1 to Z4.

The predetermined air/fuel ratio LAMB_SP is fed to a block B2, which contains a map-based pilot control and generates a lambda precontrol value LAM_FAC_PC as a function of the predetermined air/fuel ratio LAMB_SP.

Provision is also preferably made in block B3, which is embodied to take a gas travel time and a sensor behavior of the first exhaust gas probe 42 into account, with, to this end, a suitable filter being embodied in the block B3 for instance. On the input side, the predetermined air/fuel ratio LAMB_SP in block B3 is fed into the combustion chambers of the cylinders Z1 to Z4 and a correspondingly filtered predetermined air/fuel ratio is then fed to a second summing point SUM2 on the output side. In the second summing point SUM2, a control difference D_LAMB is determined as a function of the predetermined air/fuel ratio LAMB_SP and a detected air/fuel ratio LAMB_AV by forming a difference, said control difference D_LAMB being an input variable in a block B4.

The detected air/fuel ratio LAMB_AV is determined as a function of the measuring signal MS1 of the first exhaust gas probe 42 in a block B10 by means of a characteristic curve stored there, namely preferably by taking a first trim control variable TRIM_SG1 into account, with it being possible for instance for a displacement of the characteristic curve to then take place as a function of the first trim control variable TRIM_SG1.

In addition to the gas travel times and the sensor behavior, the filtering in the block B3 can also take the behavior of the exhaust gas catalytic converter 21 into account.

A linear lambda regulator is embodied in the block B4, namely preferably as a $PII^2D$ regulator. The control variable of the linear lambda regulator of block B4 is a lambda regulating value LAM_FAC_FB.

Furthermore, a block B6 is provided, in which a basic fuel mass MFF to be metered is determined as a function of a load variable LOAD, which can be an air mass flow for instance, and the predetermined air/fuel ratio LAMB_SP in the combustion chambers of the cylinders Z1 to Z4. In a linking point VK1, a fuel mass MFF_COR to be metered is determined by forming the product of the basic fuel mass MFF to be metered on the one hand and preferably a sum of the lambda precontrol value LAM_FAC_PC and the lambda regulating value LAM_FAC_FB on the other hand. The injection valve 18 is then controlled accordingly in order to meter the fuel mass MFF_COR to be metered.

A trim controller is embodied in a block B8, said trim controller being part of a trim regulator. The measuring signal MS2 of the second exhaust gas probe 44 is fed on the input side to the trim controller. The block B8 is preferably embodied to form a control difference for the trim controller as a function of a reference value of the measuring signal MS2 of the second exhaust gas probe 44 and of the measuring signal MS2 of the second exhaust gas probe 44, which is then an input variable in the trim controller.

The trim controller is preferably embodied as a PI regulator. It thus comprises a P-regulator component and an I-regulator component, to which the first trim control variable TRIM_SG1 and/or the second trim control variable TRIM_SG2 are assigned on the output side. In the block B10, the first trim control variable TRIM_SG1 acts for instance on the characteristic curve provided there, while the second trim control variable TRIM_SG2 influences the predetermined set value LAMB_SP_RAW of the air/fuel ratio for instance. Basically, the second trim control variable TRIM_SG2 can however also be fed to the block B10 and used so as to influence determination of the detected air/fuel ratio LAMB_AV. Similarly, the first trim control variable TRIM_SG1 can likewise also be provided to influence the predetermined set value LAMB_SP_RAW of the air/fuel ratio. The trim controller is regularly embodied to use the first trim control variable TRIM_SG1, contrary to the second trim control variable TRIM_SG2, only in selected operating states, in order to influence determination of the detected air/fuel ratio LAMB_AV or the predetermined set value LAMB_SP_RAW of the air/fuel ratio. The I regulator parameter assigned to the I regulator component is designed to be suitably slow and weak, so as not to react to short-term interruptions caused for instance by a tank ventilation. By means of the I regulator component, remaining control deviations are in particular to be compensated, which are produced by characteristic curve displacements of the first exhaust gas probe 42. Characteristic curve displacements of this type may develop for instance as a result of ageing or contamination.

An adjustment as a function of the control difference applied to the trim controller also only takes place in predetermined operating states both for the P regulator component and also for the I regulator component. The adjustment of the I regulator component takes place here in particular as a function of the control difference applied to the trim controller only in quasi stationary operating states of the internal combustion engine. The adjustment of the P regulator component preferably only takes place in quasi stationary operating states as a function of the control difference applied to the trim controller, with, compared with the I regulator component, the respective stationarity request of the operating state in the case of the P regulator component regularly being considerably less and thus the P regulator component in real operation being considerably more frequent dependent on the control difference applied to the input of the trim controller.

Instead of the linear lambda controller with the linear lambda regulator, a binary lambda controller can basically also be provided with an assigned binary lambda controller and assigned to the lambda controller of the trim regulator.

A flow chart of a program for operating the internal combustion engine is subsequently described in more detail with reference to FIG. 3. The program is preferably stored in a program memory of the control apparatus 25 and is processed in a computing unit of the control apparatus 25 during operation of the internal combustion engine. The program is preferably started in a step S1, for instance in real-time relative to the start of the internal combustion engine. Program variables can be initialized in step S1 for instance.

In step S2, the currently available first trim control variable TRIM_SG1 is read in. By way of example, a filtering of the first trim control variable TRIM_SG1 can also take place in step S2 with low pass filtering for instance and a filtered first trim control variable TRIM_SG1_FIL can thus be determined. In this case, the filtered first trim control variable TRIM_SG1_FIL is then used in the following steps instead of the first trim control variable TRIM_SG1.

In step S4, a check is then carried out to determine whether the first trim control variable TRIM_SG1 is greater than a predetermined trim threshold value TRIM_THD, which is determined in advance for instance by examinations on an engine test bench or by means of simulations. The evaluation as to whether the first trim control variable TRIM_SG1 is greater than the trim threshold value TRIM_THD can also include a test for instance, to determine whether this is the case for a predetermined duration T-THD or for a predetermined air mass flow integral MAF_INT_THD. It may also be sufficient if the predetermined duration T_THD is composed of several temporally different subtime durations, as is explained below for instance with the aid of the signal curves. The same also applies to the predetermined air mass flow integral MAF_INT_THD. If the condition of step S4 is not fulfilled, the processing is continued again in step S2.

If, by contrast, the condition of step S4 is fulfilled, an adjustment value ADJ is determined in step S6. The adjustment value ADJ can, in the simplest case, be fixedly predetermined for instance. It may however also be dependent on a speed N and/or a load variable and/or on the first trim control variable TRIM_SG1 and for instance by means of an engine characteristics map.

In a step S8, the adjustment of the second trim control variable TRIM_SG2 takes place, even if the predetermined operating conditions for adjusting the second trim control variable TRIM_SG2 as a function of control deviation applied to the trim regulator are not present. Preferably, but only optionally, a step S10 is processed in connection with step S8, in which the first trim control variable TRIM_SG1 is adjusted compared with step 8 by means of the adjustment value ADJ, preferably essentially in a complimentary fashion relative to the second trim control variable TRIM_SG2.

Subsequent to step S10, and/or if this is not present, the processing is then continued again in step S2 following step S8.

Figures 4A, 4B, 4C, 4D, 4E:
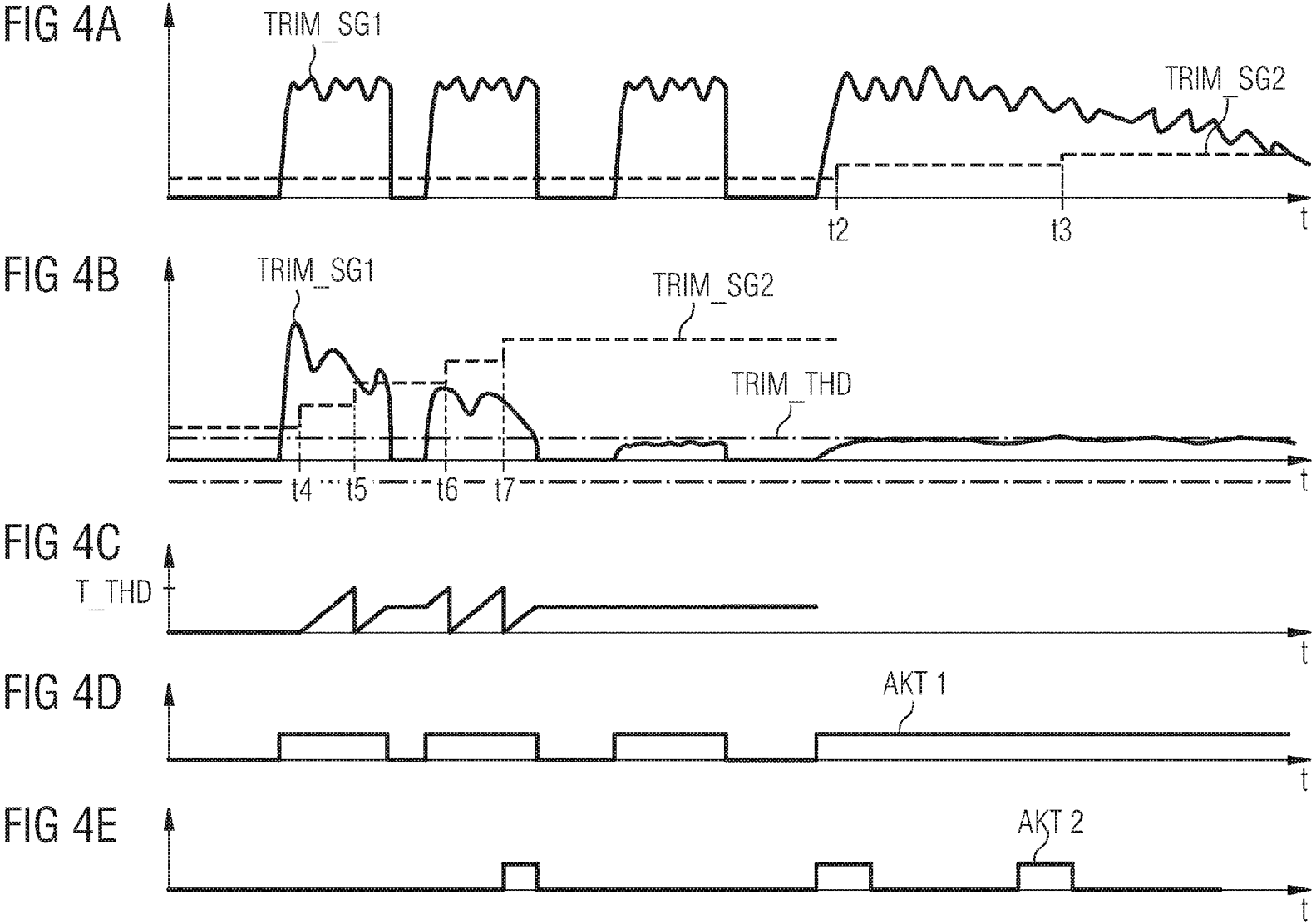

On the basis of the signal curve in FIG. 4A, plotted over time t, curves of the first and second trim control variable TRIM_SG1, TRIM_SG2 are shown, if an adjustment of the first and second trim control variables TRIM_SG1, TRIM_SG2 only takes place as a function of the control difference applied to the trim regulator. FIGS. 4D and 4E specify if activation prerequisites AKT1, AKT2 exist for an update of the first trim control variable TRIM_SG1 and/or the second trim control variable TRIM_SG2. The presence of the first activation prerequisite AKT1 results in the first trim control variable TRIM_SG1 being updated both as a function of the control difference applied to the trim controller, in other words being adjusted and also acting so as to influence the linear lambda controller, in other words in particular acting so as to adjust the characteristic curve in order to determine the detected air/fuel ratio as a function of the measuring signal MS1 of the first exhaust gas probe 42.

In respect of the second trim control variable TRIM_SG2, the presence of the second activation prerequisite AKT2 results in it essentially being possible, in this instance, to adjust the second trim control variable TRIM_SG2 as a function of the control difference applied to the trim regulator. Such an adjustment takes place according to the signal curve in FIG. 4A, thus for instance at time instants t2, t3.

Figure 3:
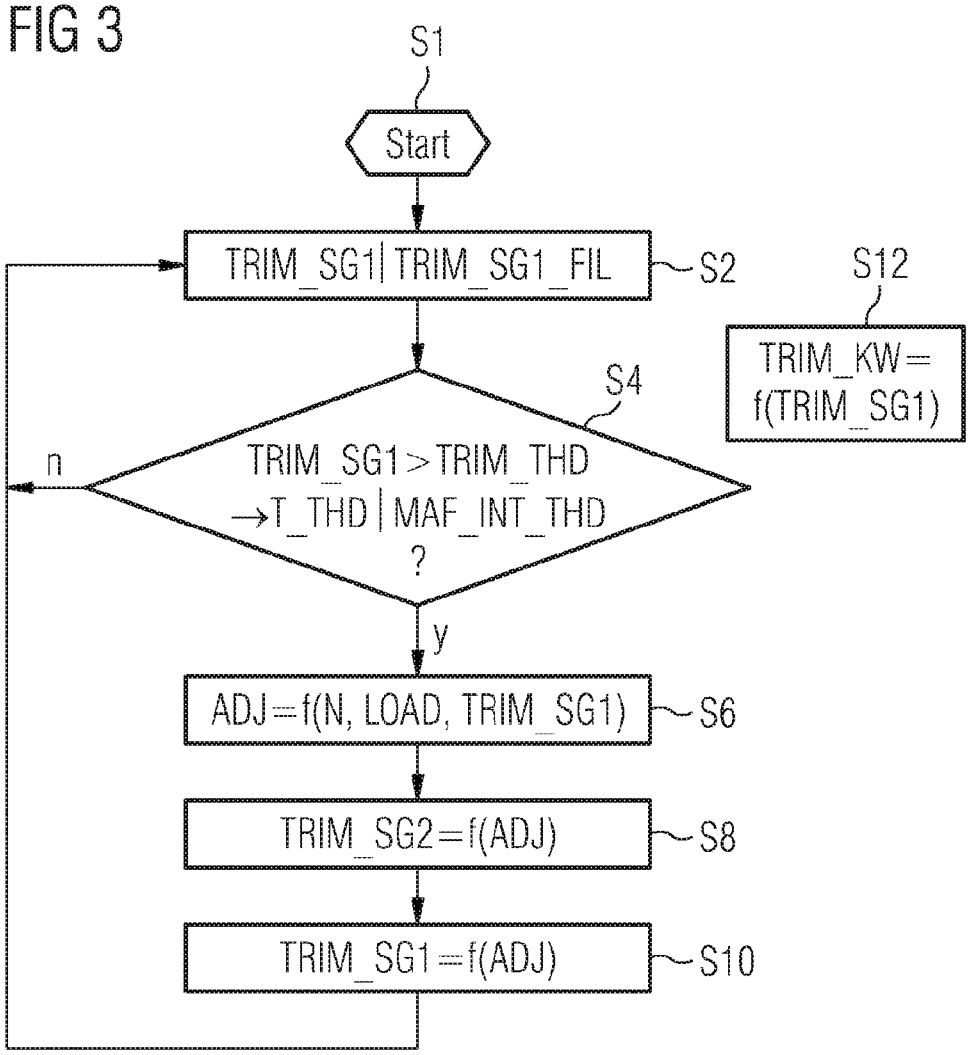
FIG. 3 shows a flow chart to operate the internal combustion engine and FIGS. 4A to 4E show signal paths plotted over time.

By means of the program according to the flow chart in FIG. 3, the second trim control variable TRIM_SG2 is adjusted in each instance once step S8 has elapsed by means of the adjustment value ADJ at time instants t4, t5, t6 and t7. FIG. 4C shows that an adjustment between two adjustments takes place at the earliest if for the predetermined duration T_THD the first trim control variable TRIM_SG1 has exceeded the trim threshold value TRIM_THD for the predetermined duration T-THD.

Alternatively, a check can naturally also be carried out here to determine whether the predetermined air mass flow integral MAF_INT_THD between two consecutive adjustments has been reached.

Within the scope of step S4, a check can optionally also be carried out to determine whether a gradient of the second trim control variable exceeds a predetermined integral threshold value according to amount and the processing in step S6 is continued if this is also the case.

Alternatively or in addition, a check can also be carried out in this context to determine whether the gradient of the second trim control variable has the same sign as the first trim control variable TRIM_SG1 and the processing can only be continued in step S6 if this is the case.

What is claimed is:

1. A method for operating an internal combustion engine having at least one cylinder, to which an injection valve is assigned for metering the fuel, having an exhaust gas tract, in which an exhaust gas catalytic converter is arranged, a first exhaust gas probe upstream of or in the exhaust gas catalytic converter and a second exhaust gas probe downstream of the exhaust gas catalytic converter, with a lambda controller being provided, the regulating variable of which is determined as a function of a measuring signal of the first exhaust gas probe and the control variable of which acts on a fuel mass to be metered by means of the injection valve, with a trim regulator also being provided, the regulating variable of which is determined as a function of a measuring signal of the second exhaust gas probe and the first control variable of which is determined as a function of a P regulator component of the trim regulator and the second trim control variable of which is determined as a function of an I regulator component of the trim regulator, with the method comprising:

as a function of a predetermined evaluation of the first trim control variable, deciding to determine whether an adjustment of the second trim control variable is to take place, implementing an adjustment of the second trim control variable, if it was decided that an adjustment of the second trim control variable is to take place.

2. The method according to claim 1, wherein a comparison of the first trim control variable or a trim characteristic value determined as a function thereof, is carried out within the scope of the evaluation with at least one predetermined trim threshold value, and a decision is made as a function of the comparison to determine whether an adjustment of the second trim control variable is to be carried out.

3. The method according to claim 2, wherein a check is carried out within the scope of the evaluation to determine whether the first trim control variable or the trim characteristic value determined as a function thereof exceeds the respective predetermined threshold value for a predetermined duration or a predetermined air mass flow integral according to amount.

4. The method according to claim 1, wherein the predetermined evaluation is implemented as a function of a filtered first trim variable.

5. The method according to claim 1, wherein a check is carried out within the scope of the evaluation to determine whether a gradient of the second trim control variable exceeds a predetermined gradient threshold value according to amount.

6. The method according to claim 5, wherein a check is carried out within the scope of the evaluation to determine whether the gradient of the trim control variable has the same sign as the first trim control variable.

7. The method according to claim 1, wherein an adjustment value is predetermined, by means of which the adjustment of the second trim control variable is implemented.

8. The method according to claim 7, wherein the adjustment value is determined as a function of a speed which represents a load variable on the internal combustion engine.

9. The method according to claim 7, wherein the adjustment value is determined as a function of the first trim control variable.

10. The method according to claim 7, wherein a complementarily acting adjustment of the first trim control variable is implemented if an adjustment of the second trim control variable is implemented by means of the adjustment value.

11. An apparatus for operating an internal combustion engine having at least one cylinder, to which an injection valve for metering fuel is assigned, comprising an exhaust gas tract, in which an exhaust gas catalytic converter is arranged, a first exhaust gas probe arranged upstream of or in the exhaust gas catalytic converter and a second exhaust gas probe downstream of the exhaust gas catalytic converter, with a lambda regulator being provided, the control variable of which is determined as a function of a measuring signal of the first exhaust gas probe, and the control variable of which acts on a fuel mass to be metered by means of the injection valve, with a trim regulator also being provided, the regulating variable of which is determined as a function of a measuring signal of the second exhaust gas probe and the first trim control variable of which is determined as a function of a P regulator component of the trim regulator and the second trim control variable of which is determined as a function of an I regulator component of the trim regulator, with the apparatus being configured, to decide as a function of a predetermined evaluation of the first trim control variable whether an adjustment of the second trim control variable is to take place and to implement an adjustment of the second trim control variable if it was decided that an adjustment of the second trim control variable is to take place.

12. The apparatus according to claim 11, wherein the apparatus is further operable to carry out a comparison of the first trim control variable or a trim characteristic value determined as a function thereof, within the scope of the evaluation with at least one predetermined trim threshold value, and to make a decision as a function of the comparison to determine whether an adjustment of the second trim control variable is to be carried out.

13. The apparatus according to claim 12, wherein the apparatus is further operable to carry out a check within the scope of the evaluation to determine whether the first trim control variable or the trim characteristic value determined as a function thereof exceeds the respective predetermined threshold value for a predetermined duration or a predetermined air mass flow integral according to amount.

14. The apparatus according to claim 11, wherein the apparatus is further operable to implement the predetermined evaluation as a function of a filtered first trim variable.

15. The apparatus according to claim 11, wherein the apparatus is further operable to carry out a check within the scope of the evaluation to determine whether a gradient of the second trim control variable exceeds a predetermined gradient threshold value according to amount.

16. The apparatus according to claim 15, wherein the apparatus is further operable to carry out a check within the scope of the evaluation to determine whether the gradient of the trim control variable has the same sign as the first trim control variable.

17. The apparatus according to claim 11, wherein the apparatus is further operable to predetermine an adjustment value, by means of which the adjustment of the second trim control variable is implemented.

18. The apparatus according to claim 17, wherein the apparatus is further operable to determine the adjustment value as a function of a speed which represents a load variable on the internal combustion engine.

19. The apparatus according to claim 17, wherein the apparatus is further operable to determine the adjustment value as a function of the first trim control variable.

20. The apparatus according to claim 17, wherein the apparatus is further operable to implement a complementarily acting adjustment of the first trim control variable if an adjustment of the second trim control variable is implemented by means of the adjustment value.

* * * * *